United States Patent [19]

Strobl, Jr. et al.

[11] 4,234,103

[45] Nov. 18, 1980

[54] DIAGNOSTIC REAGENT DISPENSING BOTTLE

[75] Inventors: Frederick P. Strobl, Jr., Cary, Ill.; David A. Winchell, Twin Lakes, Wis.; William A. DeVroom, Crystal Lake, Ill.

[73] Assignee: Baxter Travenol Laboratories, Inc., Deerfield, Ill.

[21] Appl. No.: 892,346

[22] Filed: Mar. 31, 1978

[51] Int. Cl.[3] ..... B67B 7/26

[52] U.S. Cl. ..... 222/83.5; 222/89; 222/91; 222/212; 222/420; 222/517; 222/546

[58] Field of Search ..... 222/212, 83, 83.5, 89, 222/91, 517, 546, 575, 153, 420, 421; 128/272, 272.1, 272.3, 216, 232

[56] References Cited

U.S. PATENT DOCUMENTS

| | | | |
|---|---|---|---|
| 2,873,886 | 2/1959 | Miskel et al. | 128/232 X |
| 3,240,405 | 3/1966 | Abbott | 222/546 X |
| 3,378,008 | 4/1968 | Ogle | 128/272 X |
| 3,741,447 | 6/1973 | Miles et al. | 222/517 |
| 3,991,908 | 11/1976 | Thomas et al. | 222/153 X |
| 4,065,037 | 12/1977 | Haller | 222/521 X |

FOREIGN PATENT DOCUMENTS

| | | | |
|---|---|---|---|
| 501387 | 3/1951 | Belgium | 222/420 |
| 521237 | 5/1940 | United Kingdom | 222/420 |
| 1019500 | 2/1966 | United Kingdom | 128/272 |
| 1030861 | 5/1966 | United Kingdom | 128/216 |

*Primary Examiner*—Charles A. Marmor
*Attorney, Agent, or Firm*—Paul C. Flattery; John P. Kirby, Jr.; Gary W. McFarron

[57] ABSTRACT

A diagnostic reagent dispensing bottle which includes a flexible container having an elongated cap mounting neck which is closed by a pierceable or punctureable membrane. A membrane-piercing-and-droplet-dispensing spike is also provided. The spike includes a conically-shaped orifice and a sharp membrane piercing point. The spike is carried by an elongated cap which has a body portion for mounting on the neck of the container. The neck and cap cooperate to position the spike in either (1) a shipping or non-piercing position or (2) a dispensing position wherein the spike pierces the membrane so that the reagent within the container can flow through the spike for dispensing. The cap also includes a cover or closure for closing the bottle which is hingedly connected to the cap body so that the cover is selectively positionable in either an open or closed position. Both detent and thread systems are disclosed for cooperation with the cap and neck to position and guide the spike relative to the pierceable membrane.

1 Claim, 11 Drawing Figures

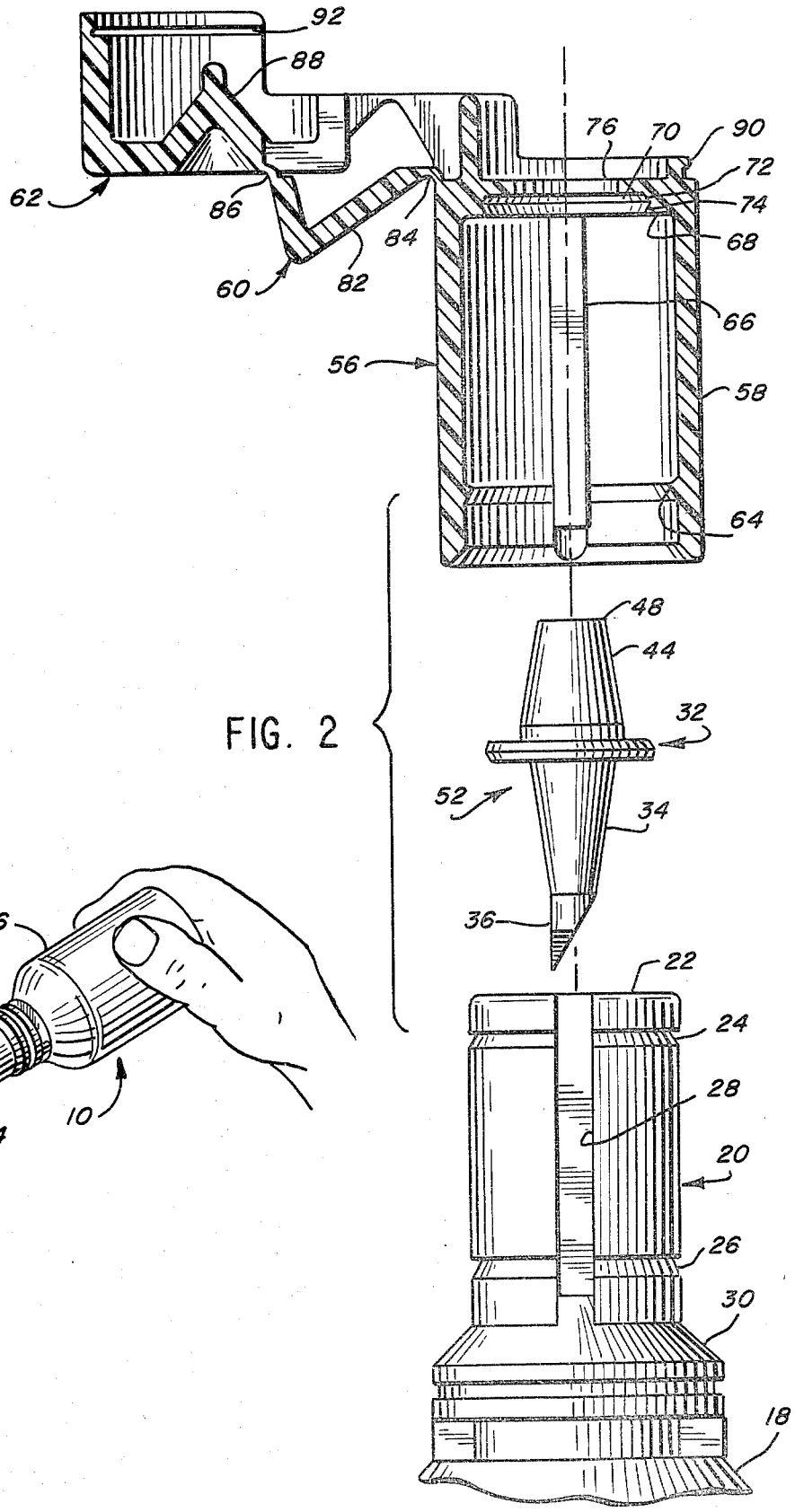
FIG. 2
FIG. 1
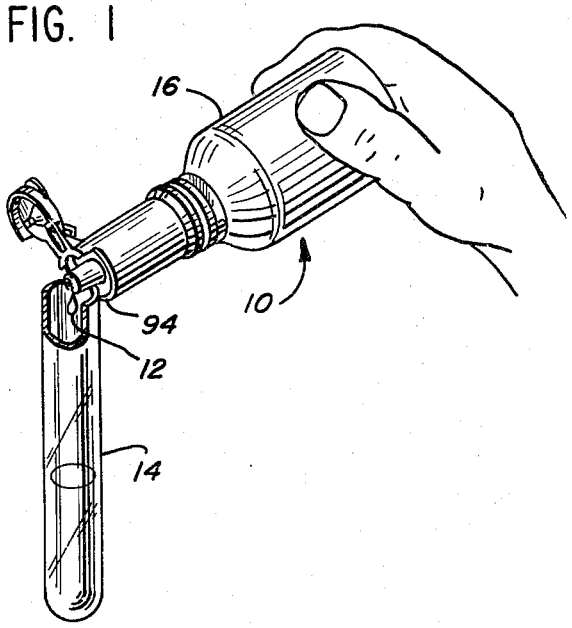

FIG. 3
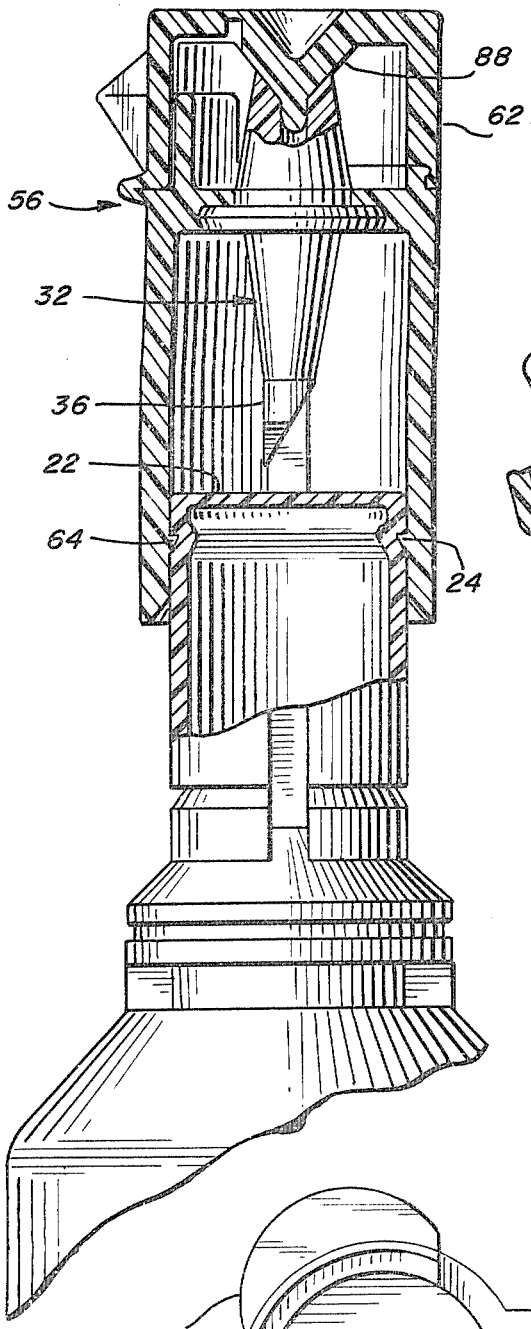
FIG. 5
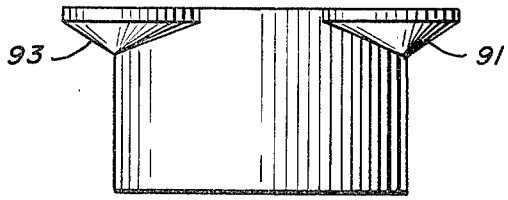
FIG. 4
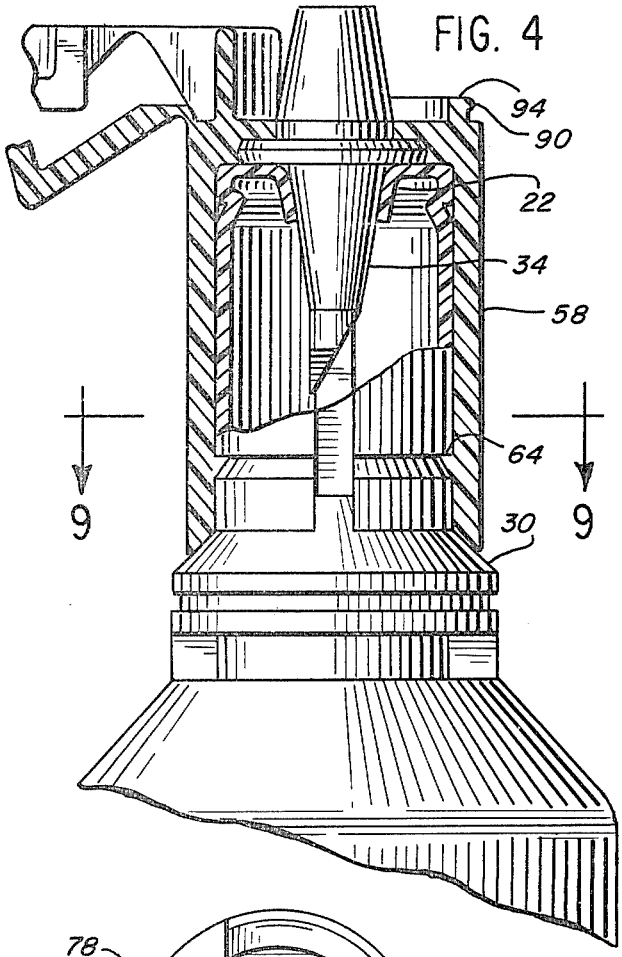
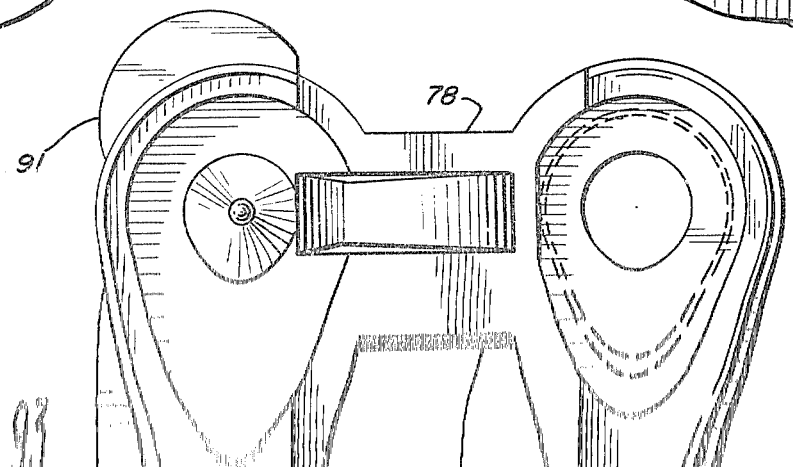

DIAGNOSTIC REAGENT DISPENSING BOTTLE

BACKGROUND OF THE INVENTION

This invention relates to liquid dispensing devices, and more particularly, to a bottle for dispensing a diagnostic reagent in droplets.

In the typing and testing of blood, very small and controlled quantities of a diagnostic reagent are added to a known quantity of blood in a test tube, the reaction of the reagent and blood is noted, and a characteristic of the blood is thus determined. Using a series of such tests with different reagents permits complete typing of the blood. Standardized test procedures have been developed and require the reagent to be dispensed as droplets with there being 20–25 droplets per milliliter (ml) of reagent.

The reagents can be quite expensive and are provided in small bottles which are referred to as BBR bottles (blood bank reagent bottles). The BBR bottles are typically made of glass, have a large mouth, and include a glass eye-dropper-like device for dispensing the reagent on a droplet-by-droplet basis.

The glass bottle is fragile, is subject to breakage during shipment and use, and when open, may be tipped over and the contents spilled. Furthermore, the number of droplets of reagent dispensed by the eye-dropper can vary due to variations in the geometry of the eye-dropper (e.g. orifice diameter, etc.) resulting from manufacturing techniques. It is also believed that the surface tension between the reagent and the eye-dropper surface may vary from reagent to reagent, which variation can also result in variations in the number of droplets per ml of reagent.

It is therefore an object of this invention to minimize bottle breakage and spillage.

It is another object of this invention to uniformly control the number of droplets of reagent dispensed to between 20–25 droplets/ml.

In using the present bottles, a technician may open a series of different BBR bottles for dispensing different reagents into test tubes. During testing (1) the technician may rest the dropper on the countertop and then return the dropper to the bottle; (2) he may touch the interior of the test tube with the eye-dropper; or (3) he might inadvertently return the dropper into a different reagent bottle. Each of the foregoing acts could result in contamination of the reagent or cross-contamination of test specimens which, in turn, could result in erroneous test results.

It is thus another object of this invention to provide a reagent dispensing system which minimizes or eliminates problems of contamination or cross-contamination.

Also during testing, it is possible that reagent bottles may be left open for substantial periods of time. By leaving the bottle open, it is possible that airborne contaminants could enter the reagent or that the bottle could be spilled. Furthermore, if the bottle is left open for prolonged lengths of time, the reagent on the dropper may dry to form a crust on the dropper. This is sometimes referred to as encrustation. It appears that the bottle is left open as a matter of convenience, since the cover is a separate piece.

It is thus another object of this invention to provide a construction wherein the cover is a part of the bottle so that closing the bottle after use is convenient.

Numerous plastic dispensing bottles are known in the prior art. These bottles generally are for the dispensing of liquids, such as detergents, cleaners and the like. Furthermore, hinges for positioning the closures on a cap or container are also known in the art. U.S. Pat. Nos. 3,289,877; 3,720,979; and 3,933,271 disclose such hinged containers. Food coloring dispensers are available which includes an inverted and conically shaped nozzle that allows the coloring agent to be dispensed as droplet. However, none of the foregoing bottles provide for the accurate metered dispensing of liquid on a droplet-by-droplet basis and the freedom of contamination and the convenience sought in the medical field. In the medical field, containers have been developed for permitting withdrawal of liquid from a container and into a syringe. See for example, U.S. Pat. Nos. 2,642,064 and 3,940,003. However, such containers are intended for a single use with all of the liquid being withdrawn at one time, not for the dispensing of such liquid on a droplet-by-droplet basis and such devices do not provide for closure and reuse of the container.

Thus the prior art does not disclose systems which provide the desired features and meet the foregoing objects. Those objects will become apparent from the following description and appended claims.

SUMMARY OF THE INVENTION

There is provided by this invention a reagent dispensing bottle which meets the foregoing objects.

The bottle includes a transparent and flexible, plastic container having an elongated cap-mounting neck which is closed by a pierceable or punctureable membrane.

A combination membrane-piercing and droplet-dispensing spike is also provided. The spike includes a nozzle, a membrane piercing point, an intermediate peripheral mounting shoulder and a longitudinal fluid passageway extending from the piercing point to the nozzle. The nozzle includes an inverted and conically shaped orifice which accurately controls droplet formation and dispensing and is self-draining.

The spike is carried by an elongated cap which has a body portion that is constructed for mounting on the neck of the container. The cap and neck cooperate to position the spike in a shipping or non-piercing position or in a dispensing position where the spike has pierced the membrane so that the reagent within the container can flow through the spike for dispensing. The cap also includes a cover or closure for closing the bottle. The cover is hingedly connected to the cap body and is selectively positionable in either an open or a closed position.

The bottle may be formed with either threads or guides-and-detents on the bottle neck with mating members being provided on the cap body for positioning the spike in the shipping or dispensing positions and for cooperation in driving the spike through the membrane. In the threaded embodiment, the cap is turned in order to drive the spike through the membrane, while in the guide-and-detent embodiment, the cap is thrust downwardly to drive the spike through the membrane.

BRIEF DESCRIPTION OF THE DRAWINGS

FIG. 1 is a perspective view showing a droplet of reagent being dispensed from a BBR bottle into a test tube;

Figure 11:
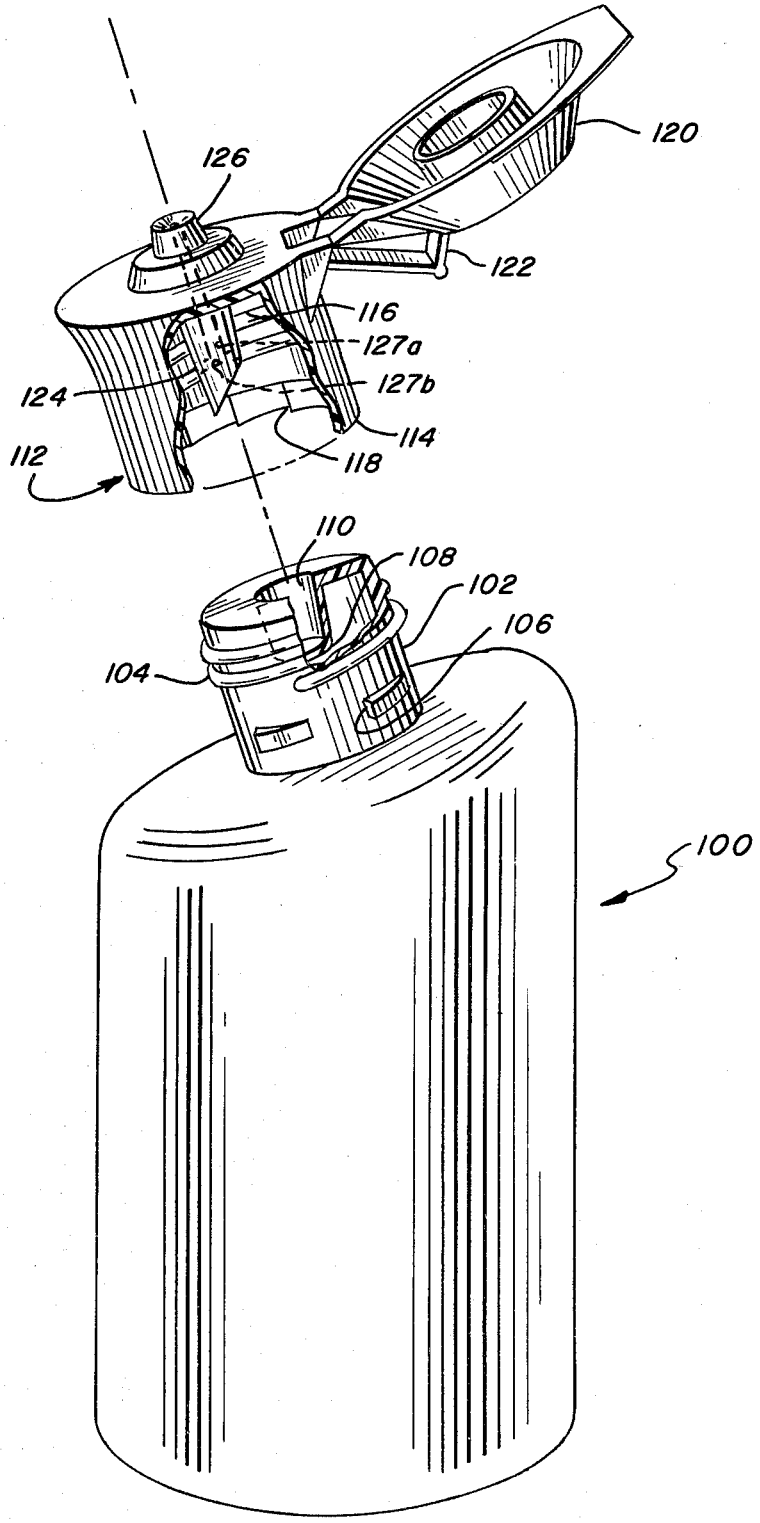

sitely tapering surfaces 72 and 74. A straight, cylindrical aperture 76 is provided above the shoulder-engaging aperture. When assembled, the nozzle section of the spike extends upwardly through the cap wall with the section 54 sealingly engaging the section 76 and the shoulder 52 snappingly and securely engaging the shoulder-retaining aperture 70.

The integrally formed hinge 60 includes a pair of pivot members 78 and 80. An active L-shaped hinge member 82 is provided which is integrally joined to the neck-engaging section 56 at a flexible pivot point 84 and to the cover at a flexible pivot point 86. Hinges of this type cause the cover to be biased either in an open or closed position. Thus as shown in FIG. 2, the cap is held and biased into the open position until the user pushes the cover toward the closed position. In the closed position, the hinge holds the cover closed.

The cover section 62 includes a nozzle-engaging tip or plug 88 which extends from the top wall of the cover toward the nozzle and is intended to engage the nozzle so as to close the fluid passageway and thus cooperate in minimizing drying of reagent and encrustation. The cover includes a pair of offset finger engageable ears 91 and 93, which permits the cap to be flicked open from a side position. This is done so as to minimize the possibility of the user touching the nozzle as he opens the cover.

A latching ridge 90 and shoulder 94 are provided on the neck-engaging body and a mating recess 92 is provided in the cover. This permits the cap to be not only closed but sealingly secured so as to prevent contamination, minimize encrustation, and require a positive act to fully open the bottle.

In an alternative cover construction, as shown in FIG. 10, the cover 95 includes a depending pin 96 which enters and sealingly engages the fluid passageway 50 and a depending sleeve or skirt 97 which sealingly engages the outer surface of the nozzle 44.

THE ASSEMBLED BOTTLE AND ITS USE

Referring now to FIGS. 3 and 4, the spike 32 is shown mounted on the cap 56 with the cover 62 in the closed position. It will be noted that the plug 88 is in engagement with the conical portion 46 of the nozzle 44. The cap is shown in its shipment position with the cap detent shoulder 64 engaging the upper detent 24, and the piercing tip 36 positioned above the punctureable membrane 22. The BBR bottle 10 is shipped in this condition, and the detent system maintains the spike above the punctureable wall, thereby maintaining the sterility of the reagent until the user decides that the product is ready for use. This positive locking minimizes accidental spillage and loss of the reagent. In this device in order for the user to begin using the reagent, he must thrust the cap 56 downwardly so as to disengage the detent shoulder 64 from the neck detent 24. When this is done, the piercing tip 36 can be pushed through the top wall or membrane 22, thereby puncturing the membrane. The cap is continued to be thrust downwardly until the detent shoulder 64 engages the lower detent 26. When the cap and spike assembly are in this position, the upper wall 22 has been pierced and the tapered section 34 of the spike sealingly engages the pierced portion of the wall. Furthermore, the detent shoulder 64 and detent 26 maintain the position of the spike and cap relative to the neck and container. During the thrusting operation, the cap was guided by the ribs 66 sliding in the guide slots 28. As can be seen in FIG. 4, the bottom edge of the neck-engaging portion 58 of the cap engages the apron 30 of the container. In this position the bottle is ready for use by the technician.

In order to use the bottle at this point all that the technician needs to do is to open the bottle using the ears 91 or 93 and then tip the bottle in order to cause liquid to flow from the container into the neck portion. By squeezing the bottle, droplets of reagent can be expressed. With this construction, the bottle can be held in an attitude anywhere from an approximately horizontal to a vertical position and accurate droplet dispensing is achieved. As previously indicated, this construction permits controlled droplet formation in the range of 20–25 droplets/ml of reagent. The latch-forming projection 90 is one portion of a shoulder 94 which can be used to rest the bottle on the test tube. Referring back to FIG. 1, it will be seen that in use a side of the nozzle portion 44 can be rested on the edge of the test tube and the shoulder 94 will help the technician position the orifice above the test tube without contamination.

THE THREADED BBR BOTTLE

Referring now to FIG. 11, another embodiment for a BBR bottle is shown. In this embodiment the bottle includes a container 100 which has a tilted and elongated neck 102. The neck is provided with a series of screw threads 104 and a set of widely-spaced ratchet-like teeth 106. A pierceable membrane 108 is provided within a recessed well 110 in the neck 102.

An integral cap and spike assembly 112 is also provided. The assembly includes a hollow, elongated cap body 114, which has a series of internal screw threads 116 and a set of closely-spaced ratchet teeth 118. The cap also includes a cover 120 which is secured by the flexible hinge assembly 122 to the cap body. A membrane-piercing spike and dispensing nozzle are molded integrally into the cap body. The spike includes a lower piercing section 124 and an upper droplet dispensing section 126. A T-shaped flow path is provided and includes a longitudinal path **127*a* that extends through the spike from the nozzle toward the piercing end and a transverse path or cross-hole 127*b* that intersects the path 127*a* and exits the spike at the piercing end. This flow path permits the reagent to flow through the spike and be dispensed from the nozzle 126**.

In shipment, the cap is positioned on the neck so that the piercing section 124 is spaced from the membrane 108 in a non-dispensing position. In order to use the bottle, the cap is twisted so that the threads 104 on the bottle and 116 on the cap cooperate to drive the spike 124 through the membrane. The rotation of the cap is continued until the ratchet teeth 118 on the cap engage the ratchet teeth 106 on the neck. The shape and spacing of both sets of the ratchet teeth are selected to prevent the cap from backing off and loosening. In other words, once the cap has been turned so as to pierce the membrane and the ratchet teeth engage, the cap cannot loosen or be backed off. Thus the cap is permanently affixed to the neck and the bottle is available for use. The convenience and features of the cover 120 are similar to those described in connection with the thrust opening type of bottle.

It will be appreciated that numerous changes and modifications can be made to the embodiment shown herein without departing from the spirit and scope of this invention.

What is claimed is:

1. A dispensing bottle for accurately and controllably dispensing droplets of a liquid, said dispensing bottle comprising:

(a) a container for holding the liquid which has a flexible containing base portion and an elongated neck extending from said base portion, said neck having a top wall which includes a piercable membrane, and said neck also having cap-positioning-and-guiding means associated therewith, which means includes upper detent means positioned adjacent the top wall of the neck and lower detent means positioned between the base portion and said upper detent means;

(b) spike means having a lower section for piercing said membrane, an upper section which defines a nozzle for accurately and controllably dispensing of droplets of liquid, the nozzle having a conical surface defining an included angle between about 70°–85°, and a fluid passage extending between the upper and lower sections of said spike means, so as to permit liquid flow from said container to said nozzle; and (c) a cap, which is a separate member from said spike means but carrying said spike means and having (1) a body portion which includes cap-positioning-and-guiding means for cooperation with said cap-positioning-and-guiding means on said neck, in positioning spike means relative to said piercable membrane and for releasably positioning said spike means in a non-piercing shipment position and securely positioning said spike means in a piercing dispensing position, said positioning-and-guiding means on the neck including a pair of diametrically opposed and longitudinally extending guide slots in the surface thereof and the positioning-and-guiding means on the cap including a pair of longitudinally extending guide ribs adapted for sliding cooperation with said guide slots to guide the cap substantially longitudinally as said cap is thrust downwardly, said cap-positioning-and-guiding means of said cap body portion including a single detent engaging rib for cooperation with both said upper and lower detent means so that when the rib engages the upper detent means, the spike is positioned in the non-piercing shipment position and when the rib engages the lower detent means, the spike extends through the piercable membrane and sealingly engages said membrane, (2) cover means for closing said dispensing bottle when not in use, said cover means including sealing means constructed for insertion into said nozzle to prevent dispensing of liquid therethrough when said cover means is closed, and (3) hinge means associated with said body portion and said cover means for selectively maintaining said cover means either in an open or a closed position.

* * * * *

United States Patent [19]

Apuzzo, Jr. et al.

[11] 4,234,104

[45] Nov. 18, 1980

[54] TOOTHPASTE DISPENSER HAVING A SLIP CLUTCH DRIVE MECHANISM

[76] Inventors: Louis J. Apuzzo, Jr., 52 Fairfield St., New Haven, Conn. 06515; Frank Acquarulo, Jr., 87 Lenox St., East Haven, Conn. 06512

[21] Appl. No.: 911,816

[22] Filed: Jun. 2, 1978

[51] Int. Cl.[3] ..... B65D 35/28

[52] U.S. Cl. ..... 222/94; 141/362; 222/96; 222/101; 222/333

[58] Field of Search ..... 222/95, 96, 97, 101, 222/102, 105, 107, 333, 390, 511, 94; 401/123, 148, 164, 155, 191; 141/360, 361, 362; 64/30 R; 46/204

[56] References Cited

U.S. PATENT DOCUMENTS

| | | | |
|---|---|---|---|
| 2,570,755 | 10/1951 | Booth | 222/101 X |
| 2,731,187 | 1/1956 | Marquis | 141/361 |
| 2,845,964 | 8/1958 | Harland | 141/361 X |
| 3,151,616 | 10/1964 | Selfon | 222/102 X |
| 3,198,389 | 8/1965 | Dunning | 222/105 X |
| 3,228,210 | 1/1966 | Farmer | 64/30 R |
| 3,481,160 | 12/1969 | Georgi | 64/30 R |
| 3,501,054 | 3/1970 | Maurice | 222/102 |
| 3,605,684 | 9/1971 | McGinley | 64/30 R |
| 3,738,533 | 6/1973 | Bertrand | 222/102 |
| 3,860,147 | 1/1975 | Vessio et al. | 222/102 X |

*Primary Examiner*—Stanley H. Tollberg
*Assistant Examiner*—Fred A. Silverberg
*Attorney, Agent, or Firm*—Bachman and LaPointe

[57] ABSTRACT

The present invention discloses an improved apparatus for dispensing paste or the like from a collapsible tube. The apparatus comprises a case having an electric motor enclosed therein which, when actuated, moves a pair of rollers downwardly on both sides of the tube to thereby force paste therefrom. In the preferred embodiment of the present invention, the case is provided with a movable closure member at the bottom thereof which seals the exit nozzle of the toothpaste tube. A motor actuation switch is positioned with respect to the closure member so that the motor is automatically actuated when a toothbrush is positioned so as to move the closure member to uncover the outlet nozzle of the tube and at the same time cause the closure member to abut the switch.

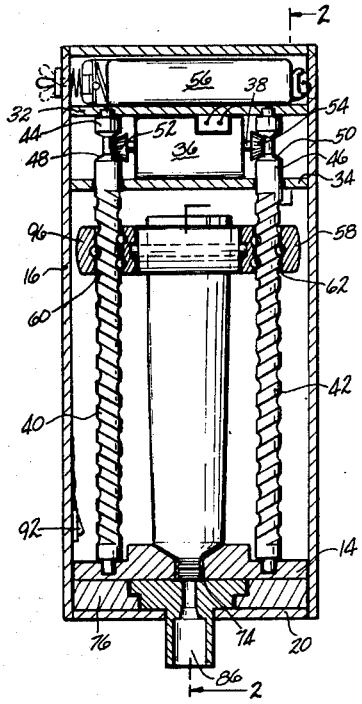

2 Claims, 3 Drawing Figures